United States Patent [19]

Mednis

[11] Patent Number: 4,708,253

[45] Date of Patent: Nov. 24, 1987

[54] MULTIPLE INTERCONNECTED CONTAINERS WITH ELONGATED NECKS AND TRANSVERSE RECESSES

[75] Inventor: Juris M. Mednis, Howell, N.J.

[73] Assignee: Universal Symetrics Corporation, Howell, N.J.

[21] Appl. No.: 927,502

[22] Filed: Nov. 6, 1986

[51] Int. Cl.[4] ..... B65D 21/02

[52] U.S. Cl. ..... 215/10; 215/1 C; 206/504; 206/509; 220/23.4; 220/23.6; 222/143; 222/530; 446/124; D9/370; D9/375

[58] Field of Search ..... 220/23.4, 23.6, 23.83, 220/23.86; 215/1 C, 10; 206/504, 509; D9/370, 372, 373, 375, 376; 222/143, 530, 534, 527, 529; 52/574

[56] References Cited

U.S. PATENT DOCUMENTS

| | | | |
|---|---|---|---|
| D. 274,699 | 7/1984 | Epperson | D9/370 |
| 3,369,688 | 2/1968 | Dilce | 222/143 |
| 4,243,161 | 1/1961 | Klygis | 215/1 C |
| 4,351,454 | 9/1982 | Maynard | D9/370 |
| 4,489,839 | 12/1984 | Epperson | 206/509 |
| 4,570,799 | 2/1986 | Mednis | 206/504 |
| 4,573,595 | 3/1986 | Mednis | 206/509 |
| 4,640,423 | 2/1987 | Mednis | 215/10 |

FOREIGN PATENT DOCUMENTS

| | | | |
|---|---|---|---|
| 162183 | 1/1949 | Austria | 52/574 |

*Primary Examiner*—George E. Lowrance
*Attorney, Agent, or Firm*—Angelo Notaro

[57] ABSTRACT

A multiple container package includes four containers which each have a polyhedral body portion with an elongated neck portion. The body portion of each container has lateral polygonal side walls, spaced apart front and rear walls a top shoulder and bottom wall. A recess which is perpendicular to the neck extends either in the front wall or the rear wall and receives the neck of an adjacent container. Four containers can be mated together to form a package having a polyhedron volume with the volume being substantially filled by the containers.

12 Claims, 6 Drawing Figures

MULTIPLE INTERCONNECTED CONTAINERS WITH ELONGATED NECKS AND TRANSVERSE RECESSES

BACKGROUND OF THE INVENTION

The present invention relates in general to containers, and in particular, to a new and useful container package which comprises a plurality of interfitted and interconnected containers each having elongated necks and transverse recesses for receiving the elongated neck of an adjacent container.

Container packages comprising individual interconnected containers each having elongated necks are disclosed in U.S. Pat. Nos. 4,573,595 and 4,570,799.

A significant advantage of both packages is that the interconnected containers together form a polyhedron. This greatly facilitates storage and shipping while, at the same time, lending a clear aesthetic advantage to the container packages.

Each of the containers of each package includes a recess which is shaped to accommodate the elongated neck of an adjacent container. The overall configuration of the interconnected containers, however, remains that of a polyhedron with little or no wasted space.

Other multiple container packages are also known which produce polyhedron or near polyhedron shapes. One example can be found in U.S. Pat. No. 3,391,834. The packages disclosed, however, have protruding neck portions with caps. This disturbs the smooth planer contours of the package.

A generally cylindrical package configuration formed by nestable containers is disclosed in U.S. Pat. No. 4,489,839.

SUMMARY OF THE INVENTION

In accordance with the invention, each container in the multiple container package has a polygonal body portion which is hollow and forms the major reservoir for the container, and an elongated neck portion which extends from the body. The end of the neck is provided with a discharge opening and may be closed by a screw-on cap, a foil covering which is sealed over the opening, a pull-tab type closure, or a combination of these closure mechanisms.

The body portion of each container has a front wall and an opposite rear wall. The elongated neck extends upwardly near the rear wall from a shoulder formed atop the body. Either the front wall or the rear wall is provided with a transverse recess which extends substantially perpendicularly to the elongated neck and which is shaped to receive any elongated neck of an adjacent container in the package.

To improve the engagement between the elongated neck of one container and the recess of an adjacent container, lateral indentations can be provided in the necks which engage with lateral projections in the recesses. The position of the indentation and projections may be reversed and still have the same function. In other words, the elongated necks may be provided with the projections and the indentations positioned within the recesses.

An advantage in providing the recesses in the rear wall or the front wall of the containers is that the containers may be engaged and disengaged from each other in a direction which is normal to a broad side of the overall multiple container package. In an embodiment of the invention wherein the recesses are provided in the front walls, four containers can be mated together with two of the containers extending parallel to each other but in opposite directions. The remaining two containers also extend parallel to each other but perpendicularly to the first pair of containers. This criss-crossing of containers produces a structurally stable package which, at the same time, is easy to disassemble. Anyone of the containers can simply be lifted out of the package without disturbin the remaining containers.

In another embodiment of the invention, the recesses are provided in the rear walls. Unlike the first embodiment, all of the rear walls lie in a common plane while all of the front walls lie in a common plane. One advantage of this second embodiment is that the common plane containing all of the front walls are free of any necks and recesses to present an uncluttered an aesthetic exterior.

The various features of novelty which characterize the invention are pointed out with particularlity in the claims annexed to and forming a part of this sepcification. For a better understanding of the invention, its operating advantages and the specific objects attained by its use, reference should be made to the accompanying drawings and descriptive matter in which preferred embodiments of the invention are illustrated.

BRIEF DESCRIPTION OF THE DRAWINGS

In the accompanying drawings, forming a part of this specification, and in which reference numerals shown in the drawings designate like or corresponding parts throughout the same.

DETAILED DESCRIPTION

Figure 1:
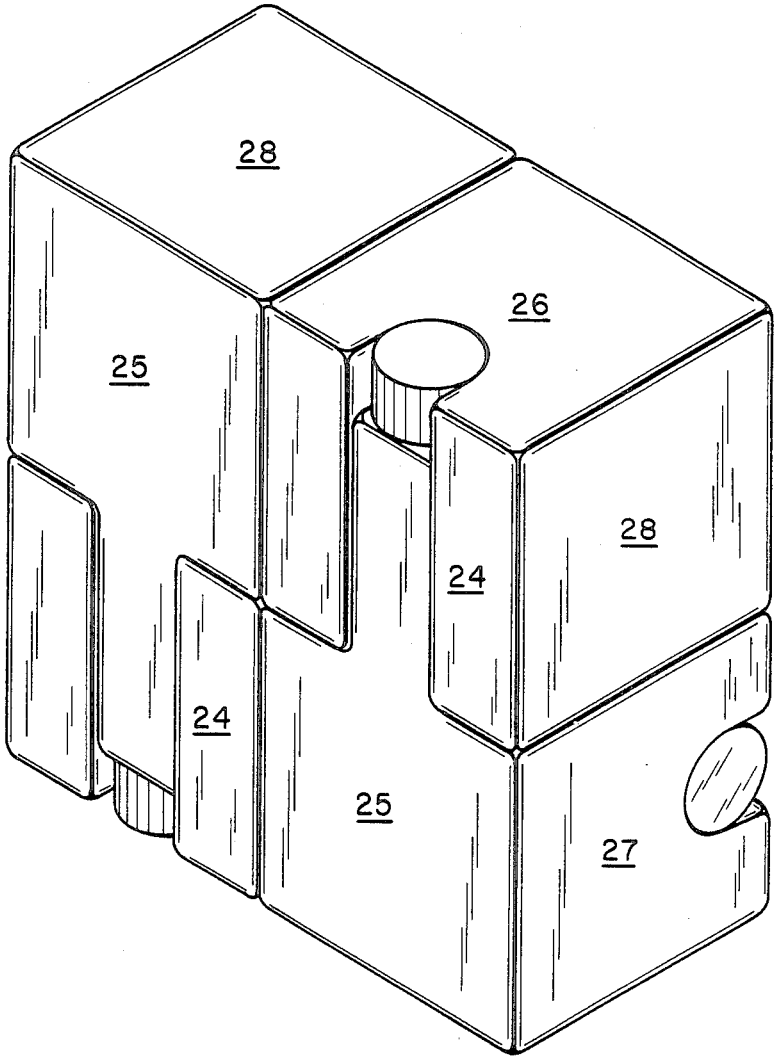
FIG. 1 is a perspective view showing a multiple container package in accordance with one embodiment of the invention.

Referring to FIG. 1 in particular, the invention embodied therein comprises a multiple container package made up of four separate containers which are mated together to form a polyhedron whose volume is substantially filled by the containers.

Figure 2:
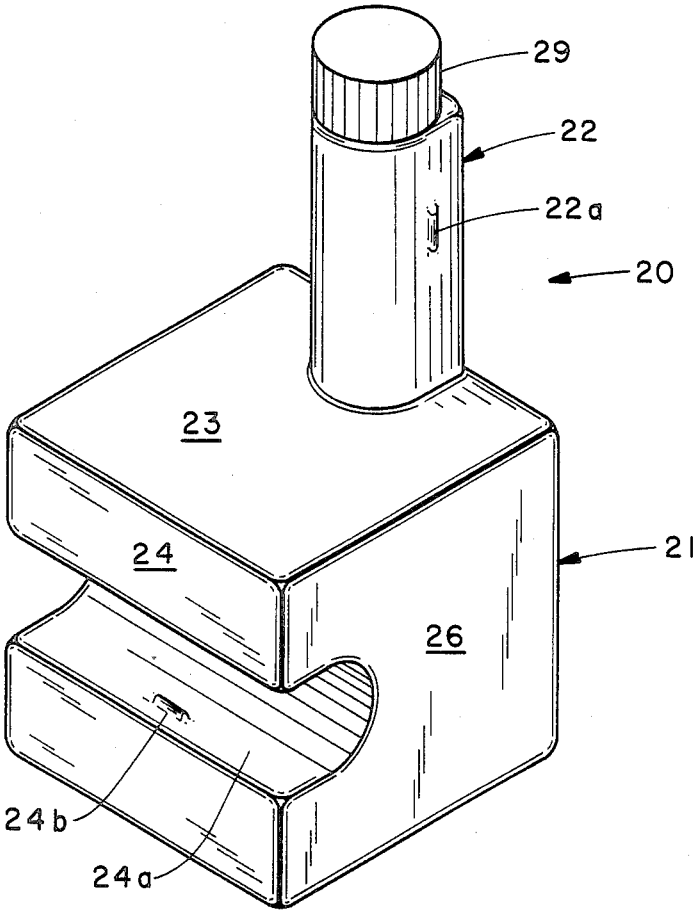
FIG. 2 is a front perspective view of a single container forming the multiple package of FIG. 1.

FIG. 2 shows an individual container generally designated 20 which can be used with three other identical containers to form the package of FIG. 1.

Each container 20 comprises a body 21 which is hollow and contains the major volume of the container. The body 21 has opposite lateral side walls 26, a front wall 24, a rear wall 25 and an upper shoulder 23. Each of these walls and shoulders are substantially polygonal in shape. Each container also has a bottom wall 28 which is also polygonal in shape. While FIG. 2 shows the shape of the shoulder, front wall and one side wall, the bottom and rear walls are illustrated in FIG. 1. It is noted that the opposite side wall 27 of each container is an identical mirror image of the side wall 26. One such side wall 27 is also evident in FIG. 1.

Each container 20 also includes an elongated neck 22 which extends from the shoulder 23 and near the rear wall 25. A cap 29 is shown screwed to the top of the neck 22.

In the embodiments of FIGS. 1 and 2, each container 20 includes a recess 24*a* in its front wall 24 which extends perpendicularly to the elongated neck 22. As shown in FIG. 1, the neck of one container is engaged within the recess of an adjacent container. Two of the containers have their back walls 25 lying in a common plane with the overall package. This common plane also contains the front walls 24 of the remaining two containers. The other side of the package also has a plane containing two rear walls and two front walls of the four containers.

To better engage each neck within each recess, the necks may include lateral indentations 22*a* which are received in lateral projections 24*b* which are disposed in the recesses 24*a*. Conversely, the necks may include projections which sit in indentations of the recesses.

Figure 3:
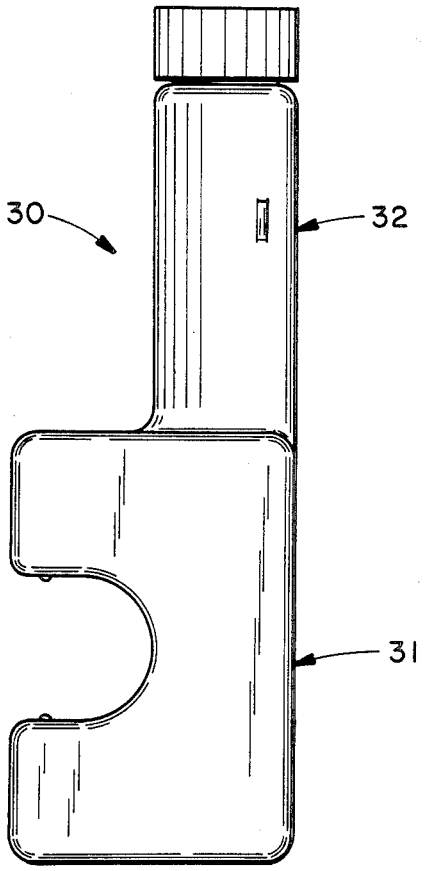
FIG. 3 is a side elevational view of another embodiment of the invention which is structurally similar to the embodiment of FIGS. 1 and 2 wherein the side walls of the container are narrower to produce a thinner multiple container package.

FIG. 3 shows a container 30 which differs from the container 20 only in that the space between the front and rear walls is less. When four containers 30 are mated together, the overall package is narrower.

Figure 4:
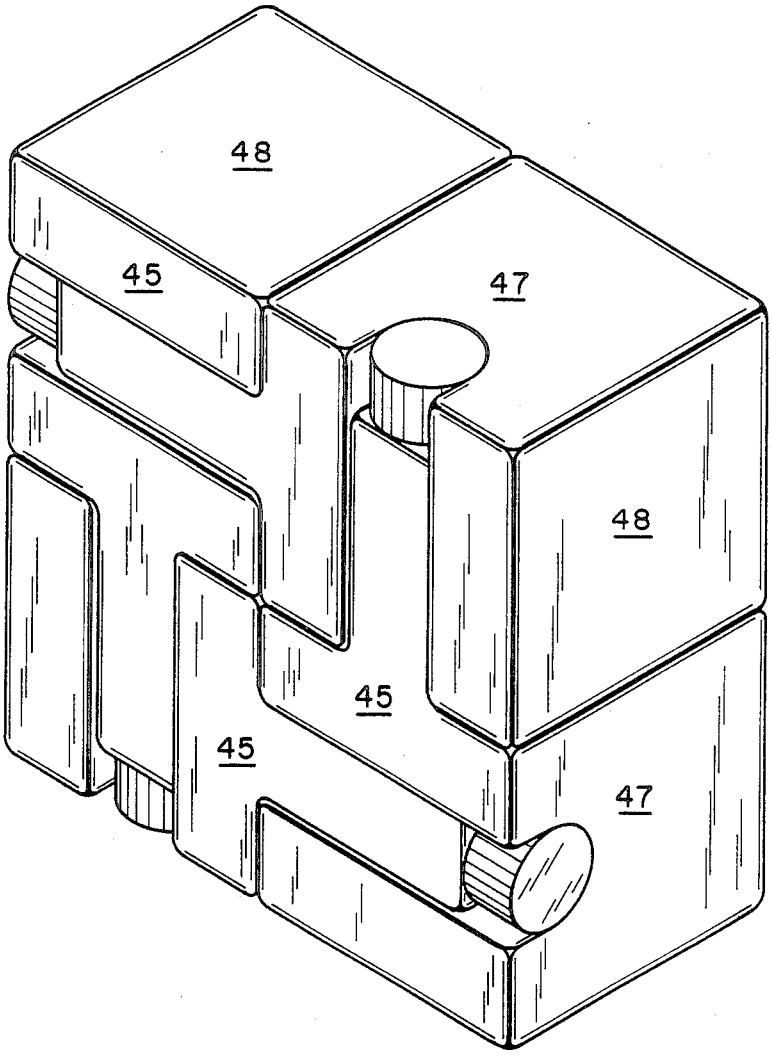
FIG. 4 is a view similar to FIG. 1 of another embodiment for the multiple container package.
Figure 5:
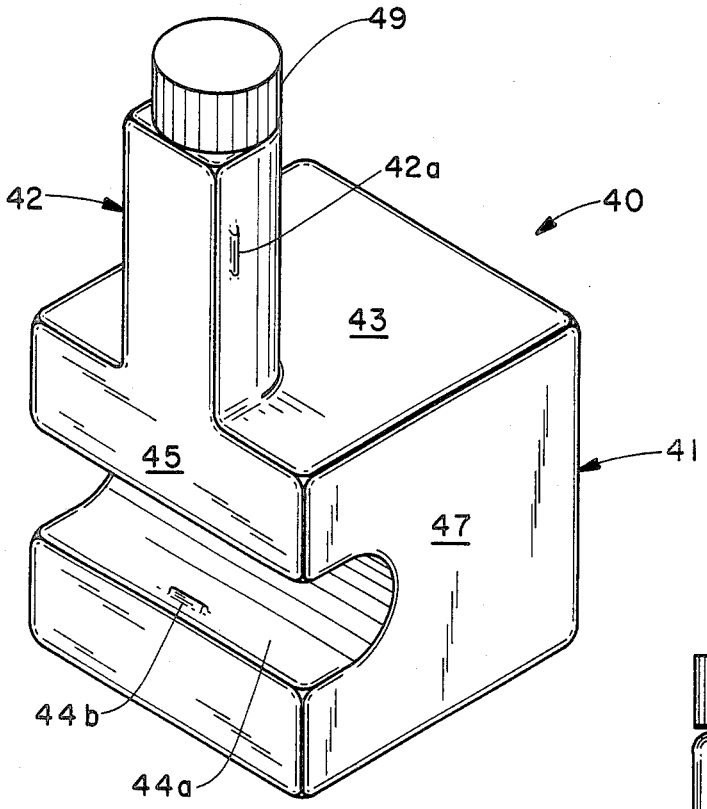
FIG. 5 is a view similar to FIG. 2 of the other embodiment according to FIG. 4.
Figure 6:
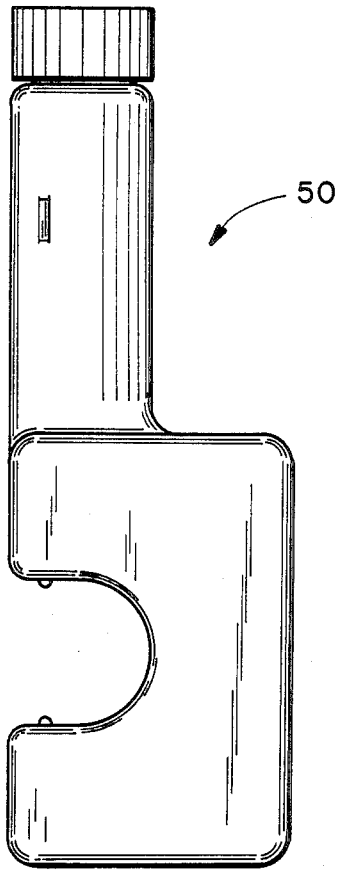
FIG. 6 is a side elevational view similar to FIG. 3 which is structurally similar to the embodiment of FIGS. 4 and 5 but which has a narrower thickness to produce a thinner multiple container package.

Turning now to FIGS. 4 through 6, these figures illustrate an embodiment of the invention wherein each of the containers 40 has a transverse recess 44*a* in its rear wall 45 rather than in its front wall as in the embodiment of FIGS. 1 through 3.

As shown in FIG. 5, the container 40 has a body 41 to which is connected an elonged neck 42 that has an upper opening covered for example by a cap 49. Neck 42 extends upwardly from a shoulder 43. The body 41 has side walls 47 (only one of which is shown in FIG. 5 the opposite being an identical mirror image thereof) and a front wall which is a plane polygon which is identical in shape to the rear wall 49 but without a recess.

FIG. 6 shows a container 50 which is structurally the same as the container 40 but which has closer together front and rear walls to produce a thinner overall package.

In the embodiments of FIGS. 1 through 3, the shoulders of the containers lie against one of the side walls of an adjacent container. The same is true of the embodiments of FIGS. 4 through 6. FIG. 5 also shows the use of lateral projections 42*a* which extend into lateral indentations 44*b* of the recess 44*a* of an adjacent container.

An advantage of all of the embodiments is that the container substantialy fill the polyhedron shape of the package. An advantage of the embodiment in FIGS. 1 and 2 is that the containers can individually be lifted out of the package without disturbing the interaction and interconnection of the remaining containers. This is not the case for the embodiment of FIGS. 4 and 5 where the entire package must be disassembled. An advantage of FIGS. 4 and 5, however, is that the side of the package which is not visible in FIG. 4 is made up of four polygonal shapes, which advantageously are square, and which are featureless. This provides an aesthetic clear side for the package which, for example, may be exposed in a display.

Whereas the present invention has been described in particular as it relates to several specific embodiments, it is understood that features of the invention can be changed without departing from the principals of the invention.

The invention claimed is:

1. A multiple container package comprising:

a plurality of mated containers which together form and substantially fill the volume of a polyhedron having opposite sides in parallel planes;

each container having a hollow body which includes a planar polygonal front wall, a planar polygonal rear wall, a planar polygonal bottom wall, opposite planar polygonal side walls and a planar polygonal top shoulder wall, each container having an elongated recess in one of said front and rear walls, said recess extending between said side walls with a length substantially equal to a width of said body between said side walls;

each container having an elongated neck extending from its shoulder wall near its rear wall, each neck extending substantially perpendicularly to said recess in its container, at least a portion of said neck being planar with said rear wall, said elongated neck having a length which is substantially equal to the length of a recess in an adjacent container of the package; and said plurality of containers being mated with the neck of one container extending in the recess of one other container and the shoulder wall of the one container being contiguous with one side wall of the one other container.

2. A package according to claim 1 wherein the recess of each container is open in the side walls of that container.

3. A package according to claim 2 comprising four containers.

4. A package according to claim 1 wherein the recess of each container is in the front wall of that container, there being four containers in said package, each parallel plane of said polyhedron containing two rear walls and two front walls of said containers.

5. A package according to claim 1 wherein the recess of each container is in the rear wall of that container, one parallel plane of said polyhedron containing said rear walls of all of said containers and the other parallel plane of the polyhedron containing the front walls of all of said containers, there being four containers in said package.

6. A package according to claim 1 wherein each of said elongated necks includes lateral indentations, each recess including lateral projections which receive said indentations.

7. A package according to claim 1 wherein each of said elongated necks includes lateral projections, each of said recesses including lateral indentations for receiving said lateral projections.

8. A container for use in a multiple container package comprising:

a body defining a hollow volume and having a front wall, an opposite rear wall, a bottom wall and opposite shoulder wall, and lateral opposite side walls, each of said walls comprising a polygon and one of said front and rear walls including a recess extending between and having a width equal to the space between said lateral side walls; and an elongated neck extending from said shoulder of said body and having an interior space communicating with the space of said body, said elongated neck being near said rear wall and extending perpendicularly to said recess.

9. A container according to claim 8 wherein said recess is in said front wall.

10. A container according to claim 8 wherein said recess is in said rear wall.

11. A container according to claim 8 including a pair of lateral indentations in said neck and a pair of lateral projections in said recess for receiving lateral indentations of another container.

12. A container according to claim 8 wherein said elongated neck includes a pair of lateral projections, said recess including a pair of lateral indentations for receiving lateral projections of another container.

* * * * *